United States Patent [19]

Chabala et al.

[11] 4,338,499

[45] Jul. 6, 1982

[54] ANTI-PARALLELING APPARATUS FOR HIGH-VOLTAGE GEAR

[75] Inventors: Leonard V. Chabala, Maywood; Walter J. Hall, Evanston, both of Ill.

[73] Assignee: S & C Electric Company, Chicago, Ill.

[21] Appl. No.: 201,684

[22] Filed: Oct. 29, 1980

[51] Int. Cl.[3] ..... H01H 9/20

[52] U.S. Cl. ..... 200/50 C

[58] Field of Search ..... 200/5 R, 5 E, 50 C, 200/153 G, 252, 288, 318

[56] References Cited

U.S. PATENT DOCUMENTS 3,303,300 2/1967 Turnbull ..... 200/50 C 3,562,452 2/1971 Keogh et al. ..... 200/50 C

*Primary Examiner*—James R. Scott

*Attorney, Agent, or Firm*—John D. Kaufmann

[57] ABSTRACT

In high-voltage switchgear, apparatus for preventing two switches from being closed at the same time to prevent their being electrically paralleled relative to a common bus. The position of each switch is mimicked by a rotatable cam having a notch. When either switch closes while the other switch is fully open, its cam moves a member into the path of the notch in the other cam which is blocked from rotating, preventing the other switch from closing. If both switches attempt to close simultaneously, the member either blocks both cams or blocks one while permitting the other to rotate. If one switch attempts to close while the other switch is closed, and if the one switch continues to attempt closure through the time the other switch opens, its cam continues to be blocked until the one switch is returned to full open.

11 Claims, 15 Drawing Figures

ANTI-PARALLELING APPARATUS FOR HIGH-VOLTAGE GEAR

BACKGROUND OF THE INVENTION

Field of the Invention

The present invention relates to improved anti-paralleling apparatus for high-voltage switchgear and, more particularly, to improved apparatus for preventing the simultaneous closure of two switches within high-voltage switchgear, which apparatus is simple and inexpensive to fabricate and associate with the switches, and exhibits improved operation.

Background of the Invention

A wide variety of high-voltage switchgear is available. Such switchgear often contains two three-phase switches. Each switch may be in series with a respective alternating, high-voltage power source, one of which is often used as a preferred power source, the other of which is often used as an alternate power source. The switches may be connected to a common bus within the switchgear. The common bus is connected to loads or other downstream devices intended to be powered by one of the sources. Normally, the switch in series with the preferred power source is closed, energizing the loads connected to the bus from the preferred power source, while the switch in series with the alternate power source is normally open. Should the preferred power source experience an interruption in service, or should it become otherwise necessary or desirable to connect the alternate power source to the loads, the normally closed switch is opened and the normally open switch is closed. These switch operations—opening or closing—may be effected manually or by motorized switch operators which may be automatically responsive to the condition and availability of the power sources.

Typically, the preferred and alternate power sources are totally separate and are not electrically associated. This, of course, assures that even if one of the sources experiences difficulty, there is a high probability the other source is available for powering the loads connected to the common bus. However, the separation and disassociation of the sources also leads to their being electrically dissimilar at any given instant in time. This dissimilarity generally manifests itself in the sources being electrically out of phase. For this reason, it is undesirable that the switches be simultaneously closed. Simultaneous closure of the switches parallels the sources via the common bus. Because the sources are out of phase, paralleling them will effect current flow therebetween, an undesirable condition which could cause damage to the sources, the gear, the loads, or the interconnections thereamong.

An overall object of the present invention, then, is the provision of improved apparatus which prevents the simultaneous closure of two separate switches in high-voltage switchgear. Specifically, this apparatus positively prevents a first switch from closing if a second switch is closed. The apparatus also prevents the switches from closing at the same time.

Anti-paralleling apparatus of various configurations and types are known in the art. Many are expensive or difficult to fabricate or to associate with the switches. Others are unreliable in operation or are quite complicated. Anti-paralleling apparatus which is wholly or primarily electrical in nature and which depends for proper operation on drawing power from the power sources are often deemed undesirable. Such undesirability arises from a possibility that one or both sources may become inoperative or unavailable while the need or desire to prevent simultaneous switch closure remains. Anti-paralleling apparatus which is electrical may alternatively be powered by a local power source, such as a local battery. Proper operation of the apparatus, therefore, depends on the availability and integrity of the local power source, which may be difficult to ensure.

Accordingly, a further object of the present invention is the provision of totally mechanical anti-paralleling apparatus which does not depend on the presence of electrical power for proper functioning.

Other types of wholly mechanical anti-paralleling apparatus are known. One type is discussed following the Detailed Description of the present invention. Certain types of known, wholly mechanical anti-paralleling apparatus prevent simultaneous closure of the switches. However, if the first switch is closed when the second switch attempts to close (which it cannot, because of the functioning of the anti-paralleling apparatus), the second switch may subsequently close in response to the first switch being opened. This occurrence is peculiar to switchgear having automatic, motorized operators which, once activated, continue to apply a closing force to their associated switches. The continuously applied force applied to the second switch is effective to close it immediately if the first switch opens. Electrically, this closure may not be deleterious to the power sources, the switchgear or the loads, because only one switch is closed. However, it may be desirable to prevent closure of the second switch any time it attempts closure while the first switch is closed until there has been intervention in addition to the opening of the first switch. As an example, a workman may approach the switchgear with the first switch closed and the second switch open not knowing that the automatic operator for the second switch is applying closing force thereto. The workman may manually open the first switch, not realizing that this has resulted in the second switch closing and in the common bus remaining energized. The workman's contact with the bus, or with items connected thereto—which he believes to be deenergized—could proved injurious to him.

Accordingly, a further more specific object of the present invention is the provision of anti-paralleling apparatus which positively prevents closure of a second switch if a first switch is closed, and which also prevents closure of the second switch after the first switch opens if an operator for the second switch attempted to initiate closure thereof (which was initially prevented by the apparatus) and continues to attempt to initiate closure through the time the first switch opens.

SUMMARY OF THE INVENTION

With the above and other objects in view, the present invention relates to improved apparatus for preventing the simultaneous closure of a first and a second switch. The switches are contained in high-voltage switchgear. The switches are operated—opened or closed—by respective operating mechanisms therefor, which may be manual operating mechanisms or automatic motorized operating mechanisms.

The improved apparatus includes a first facility which mimics the condition of the first switch. The first mimicking facility occupies a normal first position when the first switch is open. The first facility moves to an intermediate position when the operator for the first switch initiates closure thereof, but while the first switch remains open. The first mimicking facility also moves to a second position when the first switch is closed. A second mimicking facility mimics the condition of the second switch in a similar manner, that is, by occupying a normal first position when the second switch is open, by moving to an intermediate position when the operator for the second switch initiates closure thereof and the second switch is still open, and by moving to a second position when the second switch is closed. An interconnection facility cooperates with the mimicking facilities and with the switches to prevent operation of either switch if its respective mimicking facility is prevented from moving. A sequencing facility performs a plurality of functions. First, the sequencing facility permits movement of one mimicking facility between its first and intermediate positions, regardless of the position of the other mimicking facility. Second, the sequencing facility prevents movement of one mimicking facility from its intermediate position to its second position whenever the other mimicking facility is in its second position or is between its intermediate and second positions. Thus, due to the cooperation of the sequencing facility and the interconnecting facility, if the other switch is closed or is closing, the one switch cannot also be closed. Third, the sequencing facility permits movement of one mimicking facility from its first position through its intermediate and to its second position whenever the other mimicking facility is in its first position. Fourth, the sequencing facility prevents movement of one mimicking facility from its intermediate to its third position whenever the other facility is in its first position but the one facility previously moved from its first position to its intermediate position and did not return to its first position while the other mimicking facility was in its second position or was between its intermediate and second positions. Again, due to cooperation between the interconnecting facility and the sequencing facility, this permits the one switch to close only if the other switch is both open and the one switch did not attempt to close while the other switch was closed. Fifth, the sequencing facility prevents simultaneous movement of the mimicking facilities out of their intermediate and toward their second positions. Sixth, the sequencing facility permits movement of each mimicking facility from its second position through its intermediate position and to its first position.

DETAILED DESCRIPTION

Figures 1, 4:
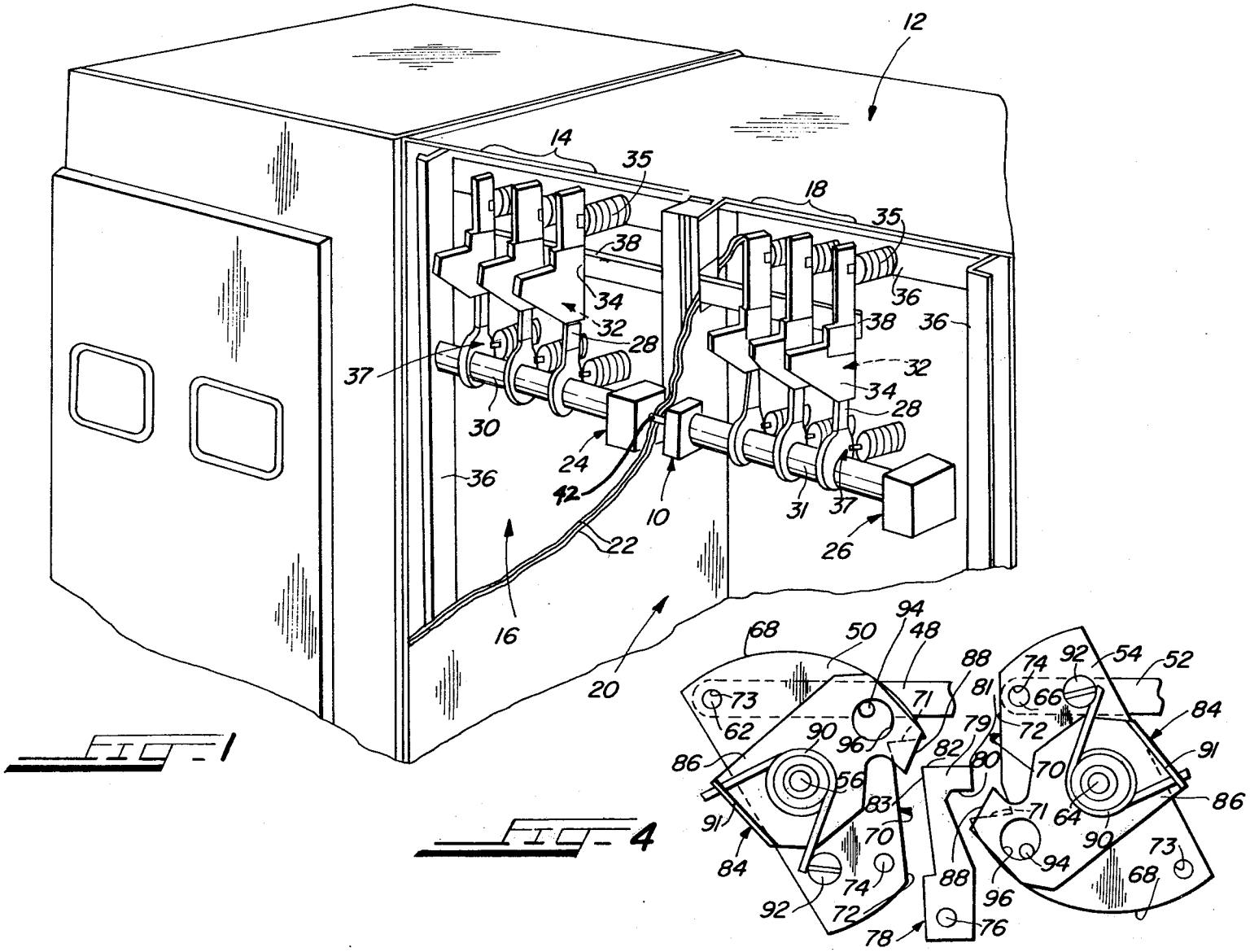
FIG. 1 is a generalized perspective view of a portion of high-voltage switchgear depicting two three-phase high-voltage switches, each operable—openable or closeable—by respective independent switch operators.
FIG. 4 is a detailed front view of the improved anti-paralleling apparatus generally depicted in FIGS. 2 and 3.

Referring to FIG. 1, an improved anti-paralleling apparatus 10 according to the present invention is usable with high-voltage switchgear generally represented at 12. The high-voltage switchgear may include a first high-voltage switch 14 within a first enclosure 16 and a second high-voltage switch 18 within a second enclosure 20. The enclosures 16 and 20 may be separate and positioned side by side or may be constructed integrally. In any event, the first and second switches 14 and 18 are maintained in separated environments by one or more side walls 22 located between or forming a portion of the enclosures 16 and 20. Each switch 14 and 18 includes a respective operator, only generally shown at 24 and 26, which is capable of opening or closing its respective switch 14 or 18. The operators 24 and 26 may be automatic and motorized, in which event the switches 14 and 18 are operated in accordance with the conditions of the circuit (not shown) connected to the switchgear 12. The operators 24 and 26 may also be manual and selectively operable.

The switches 14 and 18 are only generally described herein, but are preferably of the type more specifically disclosed in commonly-assigned U.S. Pat. Nos. 4,169,973; 3,980,977; and 3,676,629. Typically, each switch 14 and 18 includes a plurality of rotatable switchblades 28 (one for each phase of a polyphase, high-voltage circuit) mounted to respective insulative, rotative struts 30 and 31. The switchblades 28 are rotatable with their struts 30 and 31 into and out of engagement with stationary contacts, generally depicted at 32, located within arc compressors 34 which depend from insulators 35. The switches 14 and 18, including the struts 30 and 31, the stationary contacts 32 and the arc compressors 34 are mounted within their enclosures 16 and 20 by frame members 36.

Through a sliding contact arrangement, generally at 37, the switchblades 28 of each switch 14 and 18 are connectable to respective high-voltage power sources (not shown), one of which is a "preferred" source, the other of which is an "alternate" source. The stationary contacts 32 of each switch 14 and 18 are in turn connectable to high-voltage loads (not shown) via a bus 38 which is common to both switches 14 and 18. One of the switches 14 may be normally closed, that is, may have its switchblades 28 in contact with their respective stationary contacts 32, to connect the preferred source to the loads connected to the common bus 38. The other switch 18 may be open. Should the preferred source experience difficulty, the first switch 14 may be opened and the second switch 18 may be closed, thus connecting the alternate source to the loads through the common bus 38. Because the preferred source and the alternate source are independent, they are out of phase. As a consequence, it is desirable that both switches 14 and 18 not assume their closed positions at the same time in order to prevent electrically paralleling the preferred and the alternate sources relative to the common bus 38.

The operators 24 and 26 may, as mentioned above, be automatic and motorized for operating the switches—that is, opening or closing them—in accordance with the condition of the circuits to which the switchgear 12 is connected. The operators 24 and 26 may also be manually operable. As only generally shown in FIG. 1 and as more specifically shown in FIGS. 2–5, the present invention, therefore, includes the anti-paralleling apparatus 10 which prevents simultaneous closure of the first and second switch 14 and 18 regardless of the type of operators 24 and 26 used.

Figure 2:
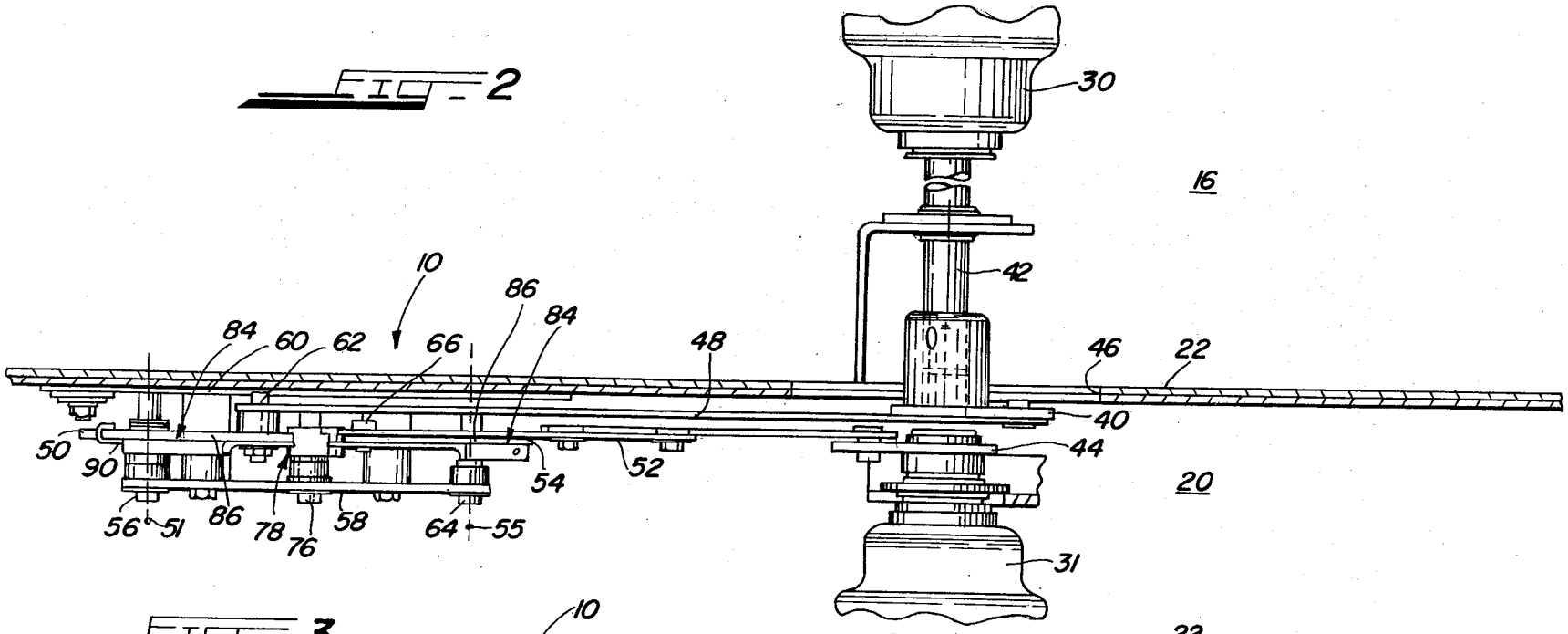
FIGS. 2 and 3 are respectively a partial plan view and a side view of a portion of the switchgear depicted in FIG. 1 and showing the relationship of the switches thereof to an improved anti-paralleling apparatus according to the present invention.

Referring now to FIG. 2, the rotatable strut 30 of the first switch 14 and the rotatable strut 31 of the second switch 18 may be seen. The operators 24 and 26 for the switches 14 and 18 are not depicted in FIG. 2 inasmuch as they form no part of the present invention. It should be understood that any type of operator 24 and 26 which is capable of effecting rotation of the struts 30 and 31 may be used with the anti-paralleling apparatus 10 of the present invention.

The struts 30 and 31 are, as may be seen in FIG. 2, located on opposite sides of the side wall 22 in the respective enclosures 16 and 20 for the first and second switches 14 and 18. The first strut 30 has locked thereto a crank 40 via a shaft extension 42. The end of the second strut 31 also has locked thereto a crank 44. A hole or cutout 46 may be formed in the side wall 22 to permit both cranks 40 and 44 to be located in the same enclosure, here the enclosure 20 for the second switch 18. Since the cranks 40 and 44 are locked to their respective struts 30 and 31, they rotate along with such struts 30 and 31 as the switchblades 28 of the switches 14 and 18 rotate to effect opening or closure thereof. By the same token, should rotation of either crank 40 or 44 be blocked or prevented, the respective switch 14 or 18 associated therewith is unable to operate, that is, is blocked against opening or closing.

Figure 3:
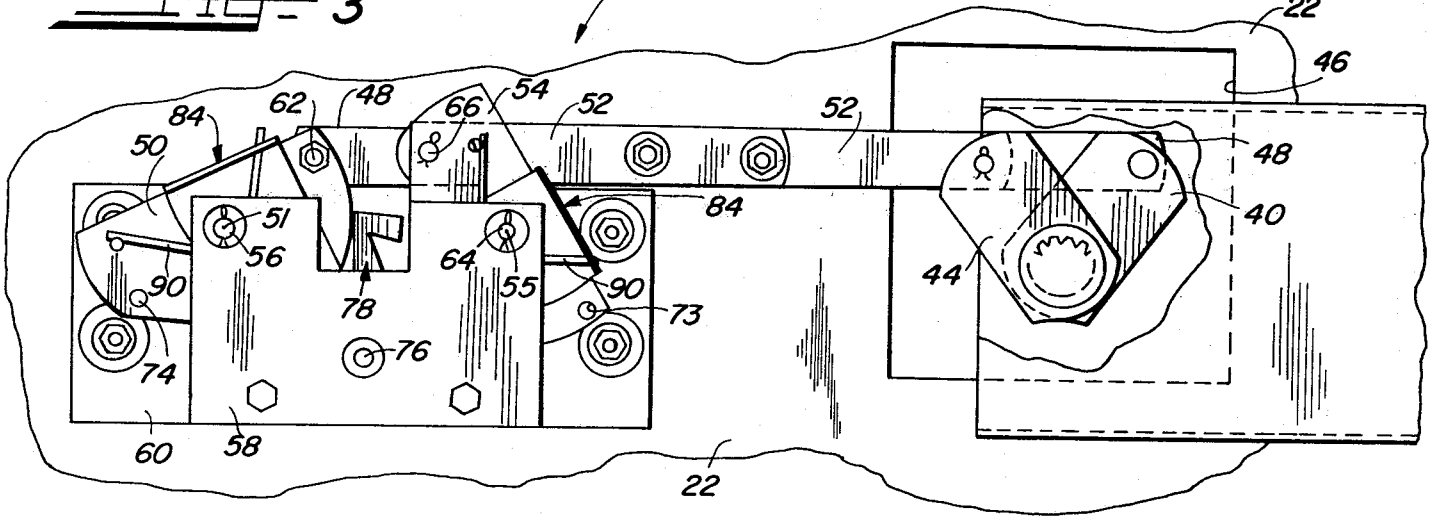

Referring now to FIGS. 2–4, the first crank 40 is connected by a link 48 to a first cam 50. Rotation of the crank 40 in response to rotation of the strut 30 reciprocates the link 48 to rotate the first cam 50 about an axis 51. The second crank 44 is connected by an adjustable link 52 to a second cam 54. Rotation of the second strut 31 during operation of the second switch 18 rotates the second crank 44 to reciprocate the second link 52, thus rotating the second cam 54 about a rotation axis 55. Preferably, the links 48 and 52 run generally parallel to each other within the enclosure 20 for the second switch 18. Further, because the cranks 40 and 44 are locked to their respective struts 30 and 31, the position of the cams 50 and 54 at any given time mimics the position of the switch 14 or 18 with which they are associated.

Referring now to FIGS. 3 and 4, the anti-paralleling apparatus 10 of the present invention is shown in detail. The first cam 50 is mounted for rotation on a pin 56 which coincides with the rotation axis 51. The pin 56 is mounted between front and rear mounting plates 58 and 60, the latter of which is mountable to the side wall 22 for fixing the position of the antiparalleling apparatus 10. A pin or a bolt 62 pivotally mounts the left end of the first link 48 to the first cam 50. Reciprocation of the link 48 rightwardly or leftwardly in response to closure or opening of the first switch 14 rotates the first cam 50 clockwise or counterclockwise. The second cam 54 is mounted on a pin 64 which coincides with the rotation point 55, the pin 64 being held between the mounting plates 58 and 60. A pin or bolt 66 pivotally mounts the second link 52 to the second cam 54 so that opening or closure of the second switch 18 pivots the second link 52 leftwardly or rightwardly to rotate the second cam 54 counterclockwise or clockwise.

The first cam 50 has a curvilinear periphery 68 in which a notch 70 is formed. The notch 70 includes a step surface 71 and a chord surface 72. A hole 73 is formed through the first cam 50 remote from the notch 70 and a hole 74 is also formed therethrough adjacent the end of the chord surface 72. The second cam 54 is comprised of similar elements which are numbered identically to the elements of the first cam 50. As explained in more detail below, the normal positions of the cams 50 and 54 are depicted in FIG. 4 to be those positions occupied when the switches 14 and 18 are opened. In this normal position of the cams 50 and 54, the notch 70 in one cam 50 or 54 faces the other cam 54 or 50, and each cam 50 or 54 occupies a position rotated about 180° away from the position occupied by the other cam 54 or 50. Further, because of the normal position occupied by the cams 50 and 54, the pin or bolt 62 is mounted in the hole 73 to pivotally attach the first link 48 to the first cam 50, while the hole 74 in the second cam 54 holds the pin 66 used to pivotally attach the second link 52 to the cam 54. The above-described arrangement permits formation of the cams 50 and 54 as identical members, thus effecting a saving in material and labor costs in fabricating the cams 50 and 54.

When the first switch 14 is open, the cam 50 occupies the position depicted in FIG. 4. Should the first switch 14 close, the first cam 50 is rotated clockwise about 70° until it occupies the approximate position depicted in FIGS. **5*h* or 5*i*. When the second switch 18 is open, the second cam 54 occupies the approximate position depicted in FIG. 4. When the second switch 18 closes, the second cam 54 rotates clockwise approximately 70° to occupy the approximate position depicted in FIGS. 5*c* or 5*d***.

Mounted on a pin 76 held between the mounting plates 58 and 60 for free pivotal movement toward and away from the cams 50 and 54 is a lever 78. The lever 78 is shaped generally like a backward numeral "7". The hook 79 of the "7" defines a first latching surface 80 on the underside thereof and a first cam follower surface 81 at the terminus thereof. The upper outside portion of the hook defines a second latching surface 82 and the upper outside portion of the main body of the "7" defines a second cam follower surface 83. The width of the hook 79 of the "7" is such that it is greater than the distance between the circular peripheries 68 of the cams 50 and 54 should they both be rotated clockwise.

Figure 5A:
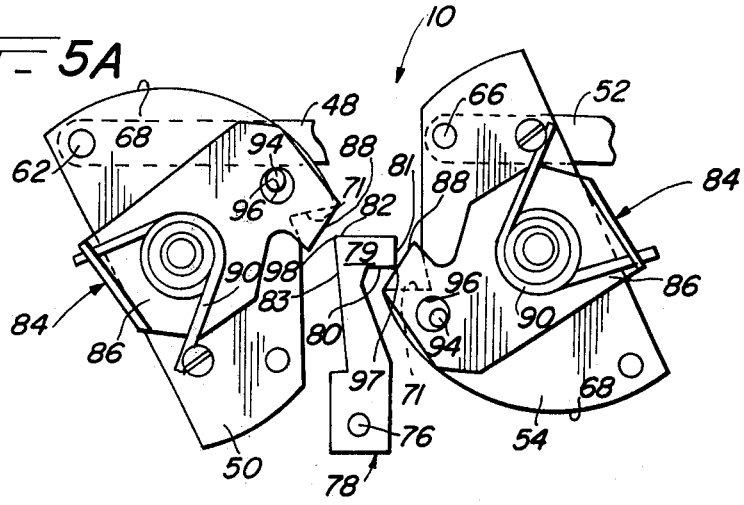
FIGS. 5*a*–5*k* depict the anti-paralleling apparatus of FIGS. 2–4 at various times during the operation of the switches of the high-voltage switchgear shown in FIG. 1.
Figure 5B:
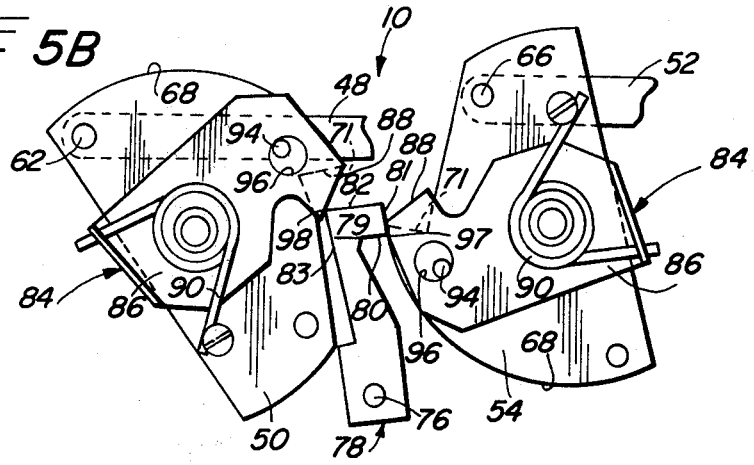
Figure 5C:
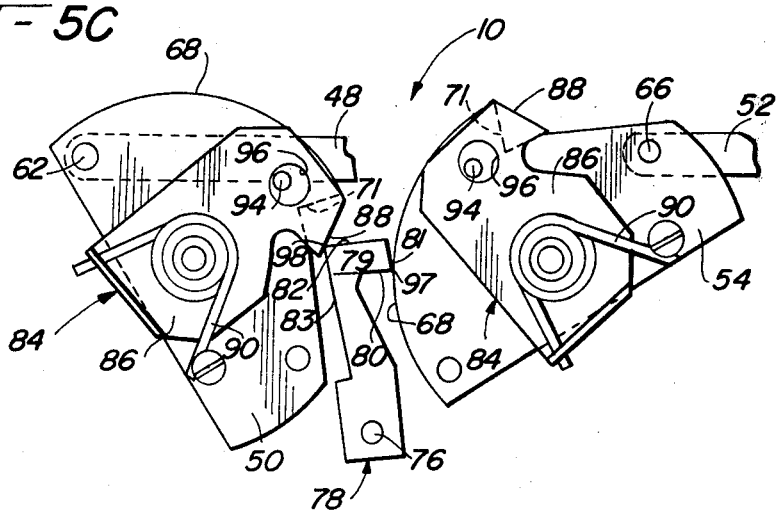
Figure 5D:
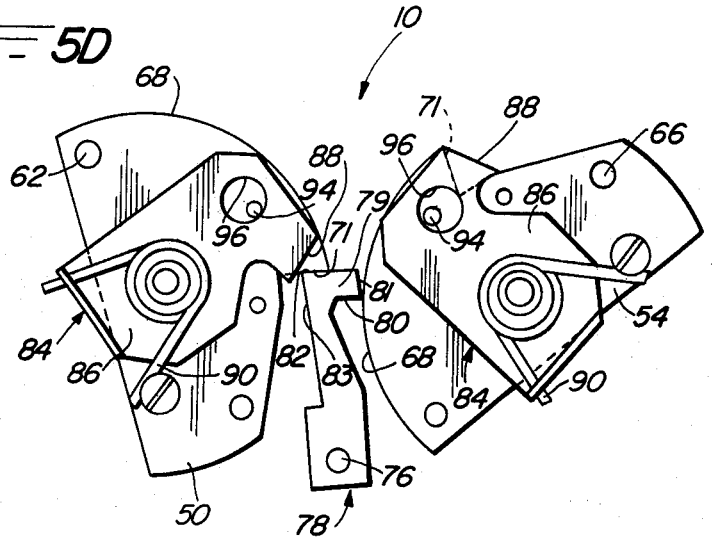
Figure 5E:
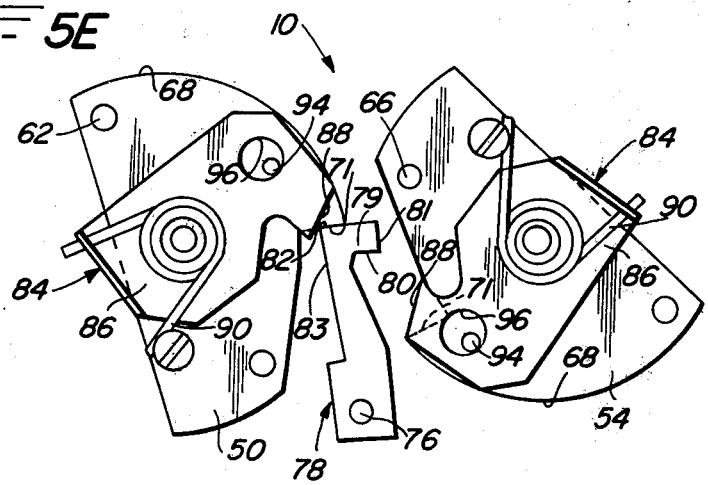
Figure 5F:
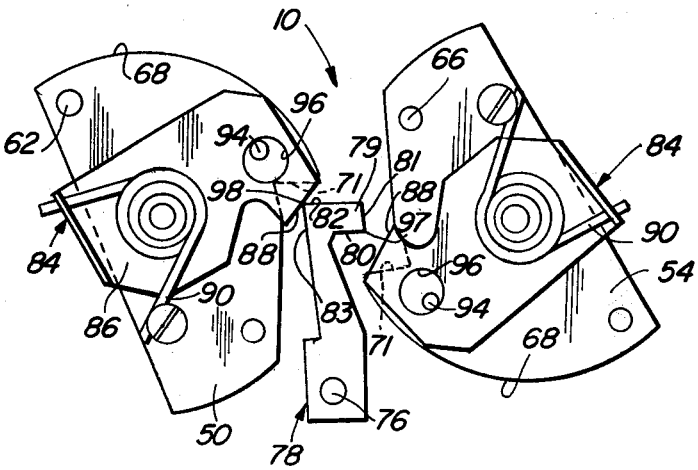

If the lever 78 is pivoted counterclockwise, that is, to the left toward the first cam 50, the latching surface 82 is positioned in the rotative path of the step surface 71. Accordingly, the first cam 50 is prevented from rotating due to interference between the step surface 71 and the latching surface 82 and the first switch 14 is unable to close. If the lever 78 is pivoted clockwise, that is, rightwardly toward the second cam 54, the latching surface 80 is positioned in the rotative path of the step surface 71 thereof. In this event, the second cam 54 is prevented from rotating clockwise; this prevents closure of the second switch 18. As best shown in FIG. **5*d*, should the lever 78 be pivoted leftwardly toward the first cam 50 and should the second cam 54 thereafter be rotated clockwise, the cam follower surface 81 of the lever 78 is held against the periphery 68 of the second cam 54 to maintain the latching surface 82 in an interferring position with respect to the step surface 71 of the first cam 50. Also, as best shown in FIG. 5*i*, should the lever 78 be pivoted righwardly toward the second cam 54, and should the first cam 50 be rotated clockwise, the cam follower surface 82 is held rightwardly by the periphery 68 of the first cam 50 to maintain the latching surface 80 in an interferring relationship with the step surface 71 of the second cam 54. Thus, both the configuration of the lever 78 and the length of the hook 79 thereof assure that only one of the cams 50 and 54** may be rotated clockwise at the same time.

Each cam 50 and 54 has mounted thereon a deflector 84. Only the deflector 84 associated with the first cam 50 is described in detail here, the deflector 84 associated with the second cam 54 being similar in all respects.

The deflector 84 comprises a plate 86 which is mounted for rotation about the rotation axis 51 independently of the first cam 50 on the pin 56. The plate 86 includes a deflector surface 88 which in the normal position of the plate 86 overlies the step surface 71, as depicted in FIG. 4. Positioned around the pin 56 is a bias spring 90, the ends of which are respectively mounted between a flange 91 of the plate 86 and to a screw 92 threaded into the first cam 50. The configuration of the bias spring 90 is such that the plate 86 is biased in a clockwise direction so that the deflector surface 88 normally overlies the step surface 71. A pin 94 mounted to the first cam 50 and extending through an enlarged hole 96 in the plate 86 sets the limits for the amount of rotation the plate 86 can experience relative to the first cam 50. The limit depicted in FIG. 4 wherein the pin 94 engages the upper left of the hole 96 is that wherein the deflector surface 88 overlies the stop surface 71. Should the plate 86 be rotated counterclockwise against the bias of the spring 90 until the pin 94 abuts the lower right of the enlarged hole 86, the deflector surface 88 similarly rotates counterclockwise uncovering the step surface 71.

As noted above, the deflector 84 associated with the second cam 54 is similar to the above-described deflector 84, and similar reference numerals relating thereto are used in FIGS. 4 and 5.

As noted previously, the normal position of the cams 50 and 54 is depicted in FIG. 4. In this so-called normal position, both switches 14 and 18 are open. In the normal position of the cams 50 and 54, the lever 78 occupies a position therebetween with an undetermined pivotal relationship with respect thereto. With reference to FIG. 5*a*, it is first assumed that the switch operator 26 operates to close the open second switch 18. In this event, because of the connection of the crank 44 to the strut 31 and connection of the adjustable link 52 to the cam 54, such cam 54 begins to rotate out of its normal or first position (FIG. 4) clockwise until the deflector surface 88 of the deflector 84 on the second cam 54 abuts an edge 97 on the lever 78 defined by the juncture of the latching surface 80 and the cam follower surface 81. For purposes of this description, the cam 54 is said to occupy an intermediate position when the edge 97 and the deflector surface 88 abut. The force applied by the bias spring 90 to the plate 86 is sufficiently high so that abutment between the deflector surface 88 and the edge 97 begins to pivot the lever 78 in a counterclockwise direction, or leftwardly, as clockwise rotation of the second cam 54 continues. At the time the deflector surface 88 abuts the edge 97 and for a short time thereafter, although the second cam 54 is rotating clockwise in and through its intermediate position, its associated switch 18 is still open. That is to say, the initiation of a closure of the open switch 18 by its operator 26 is sufficient to move the second cam 54 out of its normal or first position as depicted in FIG. 4 and into the intermediate position depicted in FIG. 5*a*, while the second switch 18 remains open.

Continued clockwise rotation of the second cam 54 as the switch 18 closes causes the deflector surface 88 to further pivot the lever 78 leftwardly until the latching surface 82 is fully positioned in the rotative path of both the deflector surface 88 and the step surface 71 of the cam 50. Following this, as shown in FIG. 5*b*, the cam follower surface 81 of the lever 78 is abutted by the periphery 68 of the second cam 54 and is thereafter held in the leftward position in the rotative path of the step surface 71 of the first cam 50. Following this, clockwise rotation of the second cam 54 continues as the switch operator 26 fully closes the second switch 18, at which time the cam 54 has rotated to a second position—approximately 70° clockwise. At this point in time, then, the second switch 18 is closed and the first switch 14 is open and the cam 54 occupies the position depicted in FIG. 5*c*.

As explained above, the anti-paralleling appartus 10 of the present invention is intended to prevent simultaneous closure of the switches 14 and 18. Accordingly, following closure of the second switch 18, it is assumed that the operator 24 attempts to close the first switch 14. Should this occur, the first cam 50 is rotated clockwise into the intermediate position whereat the deflector surface 88 of the deflector 84 associated with the first cam 50 abuts an edge 98 defined by the juncture of the latching surface 82 and the cam follower surface 83 of the lever 78. As depicted in FIG. 5*c*, because the length of the hook 79 of the lever 78 is just wide enough to fit between the periphery 68 of the second cam 54 and the chord surface 72 of the notch 70 formed in the first cam 50, the deflector surface 88 is unable to move the lever 78 rightwardly. As a consequence, engagement between the edge 98 and the deflector surface 88 rotates the plate 86 on the first cam 50 counterclockwise uncovering the step surface 71 in the first cam 50. Clockwise rotation of the first cam 50 and counterclockwise rotation of its deflector 84 continue until, as depicted in FIG. 5*d*, the latching surface 82 engages the step surface 71 of the first cam 50, following which further rotation of the first cam 50 cannot occur. Because the first cam 50 cannot rotate, its associated strut 30 is unable to rotate and the first switch 14 remains open.

It should be noted that the intermediate position of the first cam 50, depicted in FIG. 5*d*, is a result of the initiation of the closure of the first switch 18 by its operator 24, but that at the intermediate position occupied by the first cam 50 in FIG. 5*d*, the switch 14 remains open. Thus, the first position of both cams 50 and 54 is that position occupied thereby when their associated switches 14 and 18 are fully opened. When either cam 50 or 54 occupies its intermediate position—that position occupied by the cams 50 and 54 between the time the deflector surfaces 88 first engage the respective edges 98 or 97 and the time the latching surfaces 82 and 80 can engage the respective step surfaces 71—the switch operators 24 and 26 have initiated a closing operation of the switches 14 and 18, but the switches 14 and 18 remain open.

Thus, as described with respect to FIG. 5*d*, closure of the second switch 18 prevents subsequent closure of the first switch 14. It is now assumed that the second switch 18 is subsequently reopened, rotating the second cam 54 counterclockwise to its first position as depicted in FIG. 5*e*. Assuming that the operator 24 is of the type which continues to apply a closing force to the first switch 14, movement of the second cam 54 to the position shown in FIG. 5*e* does not permit the first switch 14 to close. Specifically, if the switchgear 12 contains operators 24 and 26 which, once energized, continue to apply an operating force—here a closing force—to their respective switches 14 and 18, once the second cam 54 returns to its first position and its associated switch 18 is again open, the constant rotative force applied to the first cam 50 and frictional engagement between the latching surface 82 and the step surface 71 prevent the lever 78 from pivoting rightwardly. Thus, the latching surface 82 and the step surface 71 remain in engagement, preventing clockwise rotation of the first cam 50 and closure of the first switch 14. Thus, the anti-paralleling apparatus 10, as described to this point, performs two functions when used with operators 24 and 26, which are automatic and motorized. First, it prevents the switch 14 from closing if the switch 18 has previously closed and remains closed. Second, it prevents the switch 14 from closing if the switch 18 previously closed and then subsequently reopened, but before it reopened the switch 14 attempted to close. As should be clear and assuming the various elements of the apparatus 10 have the positions shown in FIG. 5*e*, the first switch 14 may be closed only by first removing the rotative force applied to the first cam 50 to thereby break the frictional engagement between the latching surface 82 and the step surface 71. Following this, the deflector plate 86 associated with the first cam 50 returns to its original position to thereafter have the capability of moving the lever 78 rightwardly. If the operators 24 and 26 are manual, or are otherwise configured to permit the cams 50 and 54 to return to their first position following a blocked closing attempt, either switch 14 or 18 may close if the other switch 18 or 14 is open.

Figure 5G:
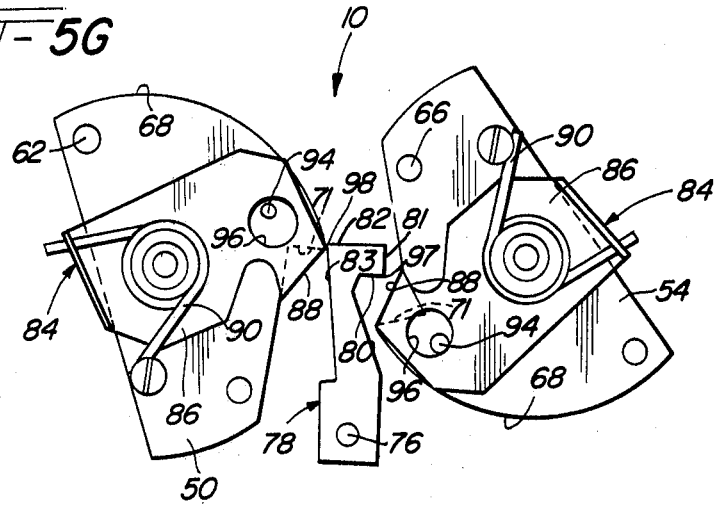
Figure 5H:
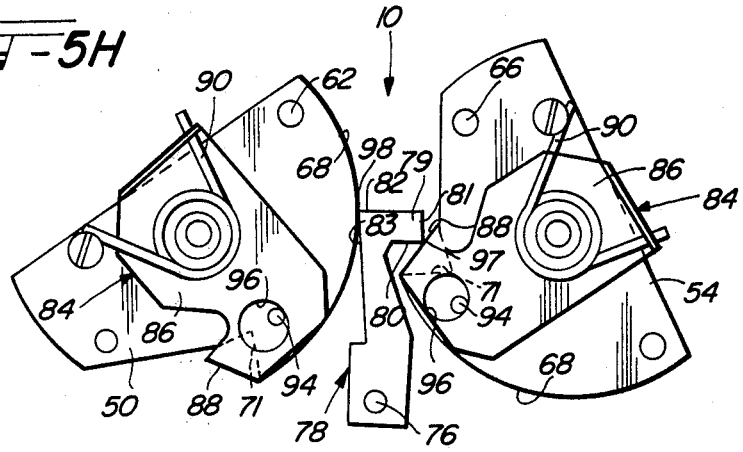
Figure 5I:
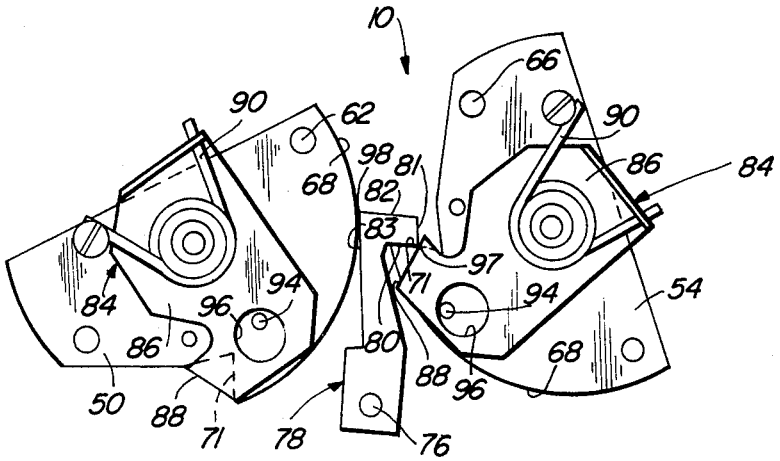

FIGS. 5*f*–5*i* depict the operation of the anti-paralleling apparatus 10 should the second switch 18 and its associated second cam 54 remain in their first positions while the first switch 14 is closed and the cam 50 is rotated clockwise. Specifically, initial rotation of the first cam 50 causes abutment between the deflector surface 88 of the plate 86 on the first cam 50 and the edge 98. Because the lever 78 is unrestrained, the bias force applied by the spring 90 to the plate 86 is sufficient to cause the deflector surface 88 to move the lever 78 rightwardly or clockwise out of the path of the step surface 71 of the first cam 50 (going from FIGS. 5*f* to 5*g*). Subsequently, the cam follower surface 83 is engaged by the periphery 68 of the first cam 50, maintaining the lever 78 in its full rightward position (FIG. 5*g*). In this position, the latching surface 80 lies in the rotative path of the step surface 71 of the second cam 54. As noted previously, movement of the first cam 50 from its first position (FIG. 4) to its intermediate position (FIGS. 5*f* and 5*g*) does not entail closure of the first switch 14, which still remains open at this time. Further clockwise rotation of the first cam 50 to the second position depicted in FIG. 5*h* represents full closure of the first switch 14. As depicted in FIG. 5*h*, the periphery 68 of the first cam 50 abuts the cam follower surface 83 holding the lever 78 in its rightward pivoted position. Consequently, as depicted in FIG. 5*i*, should closure of the second switch 18 now be attempted, the second cam 54 rotates out of its first or normal position to the intermediate position during which rotation the edge 97 rotates the plate 86 on the second cam 54 counterclockwise against the action of the bias spring 90 until the latching surface 80 engages the step surface 71 of the second cam 54. Engagement of the latching surface 80 with the step surface 71 of the second cam 54 prevents further rotation of the second cam 54 and, accordingly, blocks closure of the second switch 18. Although not depicted in the drawing, following the depiction of FIG. 5*i*, should the first cam 50 rotate clockwise to its initial position while the operator 26 continues to apply rotative force to its switch 18 and to the second cam 54, closure of the second switch 18 will be prevented in a fashion similar to that described with reference to FIG. 5*e*.

Thus, as described to this point, if either switch 14 or 18 has been moved from its open to its closed position, the other switch 18 or 14 cannot be subsequently closed due to the operation of the apparatus 10. Moreover, if a continuing attempt is made to close one of the switches 14 and 18 during the time the other switch 18 or 14 was closed and then reopened, closure of the switch 14 or 18 is prevented.

The plates 86 associated with the cams 50 and 54 bypass the lever 78 during counterclockwise rotation of the cams 50 and 54 from their second positions—wherein their respective switches 14 and 18 are closed—to their first positions—wherein their respective switches 14 and 18 are open. This is assured by the pins 94. Specifically, as the cams 50 and 54 rotate counterclockwise to their first position, the pins 94 acting on the walls of the holes 96 and the contour of the plates 86 assure that such plates 86 are freely passed counterclockwise past the edges 97 and 98 on the lever 78. Thus, the anti-paralleling apparatus 10 permits free rotation of the cams 50 and 54 from their second positions through their intermediate positions and back to their first positions and, accordingly, free opening of the switches 14 and 18 following closure thereof.

Figure 5J:
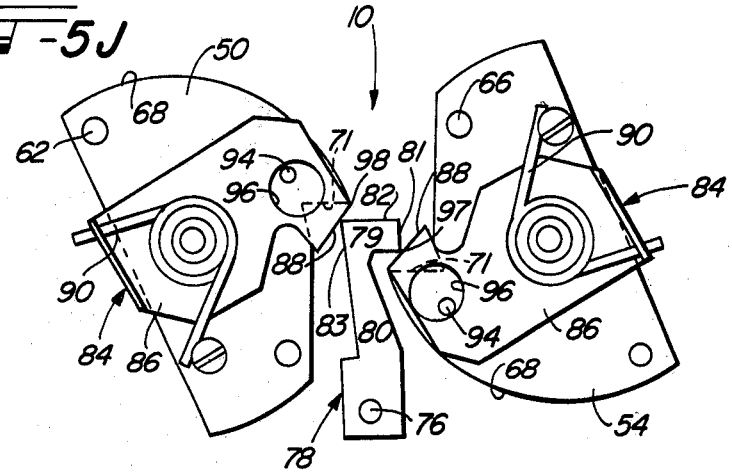
Figure 5K:
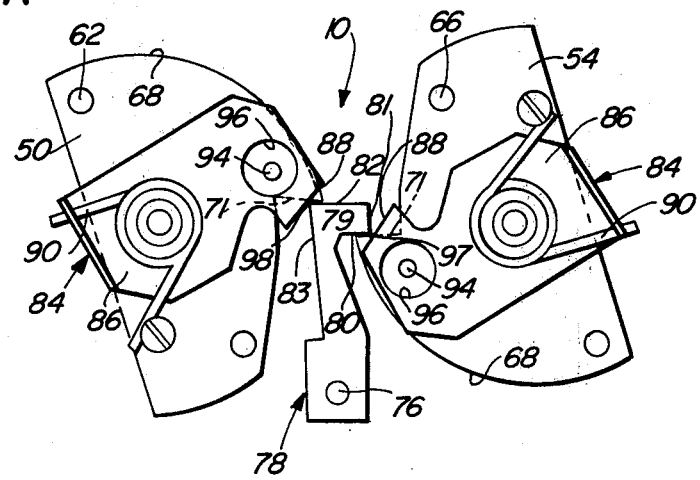

In some cases, the operators 24 and 26 may attempt to move the switches 14 and 18 from their open positions to their closed positions simultaneously, or nearly so. Should simultaneous or near simultaneous operation of the switches 14 and 18 by the operators 24 and 26 be attempted, both cams 50 and 54 will attempt to rotate clockwise simultaneously, or nearly so. Such simultaneous rotation of the cams 50 and 54 will ultimately cause abutment of both edges 97 and 98 by the deflector surfaces 88 of the deflectors 84 as both cams 50 and 54 move to their intermediate positions as depicted in FIG. 5*j*. In the intermediate position of the cams 50 and 54 depicted in FIG. 5*j*, both switches 14 and 18 are still open. Further, simultaneous clockwise rotation of the cams 50 and 54 cause both plates 86 to be rotated counterclockwise due to the abutment between the edges 98 and 97 and the deflector surfaces 88. Subsequently, both step surfaces 71 are blocked by the respective latching surfaces 82 and 80 of the lever 78 preventing further rotation of either cam 50 and 54, and, consequently, preventing the closure of either switch 14 or 18. Should a constant rotational force applied to one of the cams 50 and 54 be relieved and the cam 50 or 54 be returned to its first position, the other cam 54 or 50 will, nevertheless, continue to be held in place by its associated latching surface 82 or 80 due to the previously described frictional engagement between such latching surface 82 or 80 and the respective step surface 71.

Should closure of the switches 14 and 18 be attempted at about the same time, but not quite simultaneously, the first cam 50 or 54 to rotate clockwise sufficiently to move the lever 78 toward the other cam 54 or 50 will be free to rotate while the other cam 54 or 50 will be prevented from rotation, thus preventing closure of the associated switch 18 or 14. Which cam will "win" this "race" will depend on a number of factors, including manufacturing tolerances and the precise shape and orientation of the lever 78. Since the lever 78 is preferably unbiased and may have a rest position (when the cams 50 and 54 occupy positions shown in FIG. 4) anywhere between the cams 50 and 54, it is difficult to determine which, if either, of the cams 50 and 54 will be prevented from rotating. The fact that it cannot be predicted which switch 14 or 18 will be permitted to close is, in preferred embodiments, relatively unimportant, since the ultimate intent of the operation of the apparatus 10 is to permit only one switch to close at a time. If it is desired that simultaneous or near simultaneous closure of the switches 14 and 18 should effect closure of a selected one of the switches 14 or 18 while the other switch 18 or 14 is held open, a bias force in an appropriate direction may be applied to the lever 78 by a spring or the like.

It is to be understood that the above-described embodiments of the present invention are simply illustrative of the principles thereof. Various modification and changes may be deviced by those skilled in the art which embody the principles of this invention and fall within the spirit and scope of the claims hereof. For example, the elements depicted in, particularly the cam 50 and 54, the deflectors 84, and the levers 78, need not take the exact configurations depicted in the drawing as long as the functions thereof are as described herein. Moreover, both cams 50 and 54 need not rotate in the same direction (clockwise or counterclockwise) when their switches 14 and 18 open or close. One cam 50 or 54 may be the mirror image of the other cam 54 or 50. In this event, one cam 50 or 54 rotates clockwise when its switch 14 or 18 closes and counterclockwise when its switch 14 or 18 opens. The other cam 54 or 50 rotates counterclockwise when its switch 18 or 14 closes and clockwise when its switch 18 or 14 opens. This, of course, may necessitate attaching the links 48 and 52 to the cams 50 and 54 at points other than those depicted; further, the links 48 and 52 may not be parallel, nor need they be. If the cams 50 and 54 are related to this mirror-image fashion, the lever 78 may take a more symmetric configuration, cruciform, for example.

In the prior art, it is known to mount a "B"-shaped cam to each of the struts 30 and 31 or to connect such cams to the struts 30 and 31 so that the position of the "B" cams mimics the position of the switches 14 and 18. The inwardly directed portion of the "B" is configured so as to accommodate the movement therepast of the top or bottom of the "B" of the other cam. In this prior art configuration, assuming both switches to be open, should one switch close, the top or bottom of the "B" of its cam moves into the inwardly directed portion of the "B" of the other cam, preventing its rotation. The present invention is an improvement on this prior art arrangement for several reasons. First, at least the link 52 is adjustable. Accordingly, once the switches 14 and 18 and the struts 30 and 31 with the cranks 40 and 44 thereon are mounted within their enclosures 16 and 20, the links 48 and 52 may easily be positioned and adjusted so that the links 48 and 52 are properly connectable to the pins 62 and 66. Thus, the exact position and alignment of the struts 30 and 31, which may vary due to normal manufacturing tolerences, is not crucial. However, in the "B" cam arrangement of the prior art, it is necessary to precisely align the axes of the struts 30 or 31 or of other members to which the "B" cams are mounted. Second, in the arrangement of the prior art, if it was desired to mount the "B" cams directly to the strut 30 or 31 or to extensions thereof, the relative elevation or back-to-front location of the switches 14 and 18 in the enclosures 16 and 20 was different. The present invention permits the location of each switch 14 and 18 in its enclosure 16 and 20 to be the same. Third, in the "B" cam arrangement of the prior art, if one switch had been closed, following which closure of the second switch was attempted by a motorized, automatic operator 24 or 26, the second switch would close upon reopening of the first switch due to the constant rotative force applied by the operator 24 or 26 to the strut 30 or 31. In the present invention, should one switch 14 or 18 attempt to close while the other switch 18 or 14 is closed, closure of the one switch is prevented when the closed switch is reopened unless the constant rotative force applied to the strut of the one switch is relieved.

The present invention may also be used to prevent either switch 14 or 18 from closing while the other switch 18 or 14 is open, and vice versa, by appropriately altering the orientation and location of the cranks 40 and 44, the links 48 and 52, and the cams 50 and 54. Moreover, one of the switches 14 or 18 may be replaced by a grounding switch or the like.

We claim:

1. In high-voltage switchgear of the type having first and second switches which are each movable between a full open state and a full closed state by respective first and second operating mechanisms, improved apparatus for preventing one switch from residing in a selected one of its states at the same time the other switch resides in a selected one of its states, which apparatus comprises:

(a) first means for mimicking the state of the first switch, the first mimicking means having a normal first position when the first switch is in the other state, and being movable first to an intermediate position as movement of the first switch to the one state is initiated by its operating mechanism while the first switch remains in the other state and then to a second position when the first switch is in the one state;

(b) second means for mimicking the state of the second switch, the second mimicking means having a normal first position when the second switch is in the other state, and being movable first to an intermediate position as movement of the second switch to the one state is initiated by its operating mechanism while the second switch remains in the other state and then to a second position when the second switch is in the one state;

(c) interconnection means for preventing operation of either switch, the respective mimicking means of which is prevented from moving; and (d) sequencing means for (i) permitting movement of each mimicking means between its first and intermediate positions regardless of the position of the other mimicking means, (ii) preventing movement of one mimicking means from its intermediate position to its second position whenever the other mimicking means is in its second position or is between its intermediate and second positions, (iii) permitting movement of each mimicking means from its first position through its intermediate position to its second position whenever the other mimicking means is in its first position, (iv) preventing movement of one mimicking means from its intermediate position to its second position whenever the other mimicking means is in its first position but the one mimicking means previously moved from its first position to its intermediate position and did not return to its first position while the other mimicking means was in its second position or was between its intermediate and second positions, (v) preventing simultaneous movement of the mimicking means out of their intermediate and toward their second positions, and (vi) permitting movement of each mimicking means from its second position through its intermediate position and to its first position.

2. Improved apparatus as in claim 1, wherein the sequencing means prevents simultaneous movement of the mimicking means out of their intermediate and toward their second positions by either (a) permitting each mimicking means to move from its first position to its intermediate position followed by holding each mimicking means in its intermediate positions, or (b) permitting one mimicking means to move from its first position through its intermediate position and to its second position while permitting the other mimicking means to move to, and then holding the other mimicking means in, its intermediate position.

3. Improved apparatus as in claim 1 or 2, wherein the one state of each switch is its full open state and the other state of each switch is its full closed state.

4. Improved apparatus as in claim 1 or 2 for use in high-voltage switchgear, each operating mechanism of which continues to attempt to move its respective switch from the other state to the one state notwithstanding the inability of the switch to so move due to the prevention of movement of the associated mimicking means, wherein if one mimicking means moves to its intermediate position while the other mimicking means is in its second position or is between its intermediate and second positions, the one mimicking means is held in its intermediate position and does not thereafter return to its first position due to the continued attempt by the associated operating mechanism to move its respective switch to the one state, and, accordingly, the one mimicking means remains in its intermediate position even after the other mimicking means returns to its first position.

5. Improved apparatus as in claim 1 or 2, for use in high-voltage switchgear, each operating mechanism of which permits its respective switch to move back to or toward its other state if the switch is unable to move to its one state due to the prevention of movement of the associated mimicking means, wherein if one mimicking means first moves to its intermediate position while the other mimicking means is in its second position or between its intermediate or second positions, the one mimicking means thereafter moves back to or toward its first position due to the movement of its associated switch back to or toward its other state, and, accordingly, the one mimicking means if free to thereafter move through its intermediate and to its second position after the other mimicking means returns to its first position.

6. Improved apparatus, as in claim 1 or 2, wherein the first and second mimicking means each comprises a cam having a curvilinear periphery with a notch formed therein, and means for mounting the cams for rotation on separated axes so that when either cam is in its first position, its notch generally faces the other cam, and so that when either cam is in its second position, its periphery generally faces the other cam; and the sequencing means comprises a member mounted for movement between the cams, the member having a latch surface movable by movement of the member into the rotative path of the notch in either cam for blocking rotation of the cams out of their intermediate and toward their second position, and a cam follower engageable by the periphery of either cam when it is in its second position or moving between its intermediate and second positions for moving the latch surface of the member into the rotative path of the notch of the other cam.

7. Improved apparatus as in claim 6, wherein the cams are mounted for coplanar rotation, and the member comprises a lever mounted between the cams for coplanar pivoting with respect thereto.

8. Improved apparatus as in claim 6, wherein the width of the member is sufficiently large so that the latch surface may reside simultaneously in the rotative path of the notches, and the fourth sequencing means further comprises deflector means on each cam responsive to rotation thereof for deflecting the latch surface engageable with its respective notch out of the rotative path thereof by moving the member toward the other cam whenever the other cam is in its first position, and permitting the latch surface engageable with its respective notch to engage the notch if the other cam is in its second position or between its intermediate and second positions.

9. Improved apparatus as in claim 6, wherein each deflector means comprises a deflector plate mounted on each cam for movement relative thereto, a deflector surface on each plate, means for biasing the deflector surface to overlie the notch and to have a rotative path intersected by the latch surface, the force of the bias being sufficiently high to move the member toward the other cam if the other cam is in its first position, the bias being overcome by engagement between the latch surface and the deflector surface if the other cam is in its second position or between its intermediate and second positions to move the deflector plate and uncover the notch for engagement thereof by the latch surface.

10. In high-voltage switchgear of the type having first and second three-phase, high-voltage switches connected to a common bus, improved apparatus for preventing simultaneous closure of the switches by respective operating mechanisms therefor to thereby prevent the sources from being in electrical parallel, wherein the improved apparatus comprises:

a first cam having a curvilinear periphery with a first notch therein, the first cam rotating to a first position when the first switch opens and rotating to a second position when the first switch closes;

a second cam having a curvilinear periphery with a second notch therein, the second cam rotating to a first position when the second switch opens and rotating to a second position when the second switch closes; the first position of the first cam being characterized by the first notch facing the second cam, the second position of the first cam being characterized by its periphery facing the second cam, the first position of the second cam being characterized by the second notch facing the first cam, the second position of the second cam being characterized by its periphery facing the first cam;

means for mounting the cams for coplanar rotation on separated axes and for preventing operation of their respective switches if they are prevented from rotating;

a lever mounted between the cams for pivoting in the plane of rotation thereof toward and away therefrom;

a first latch surface on the lever engageable with the first notch to prevent rotation of the first cam out of its first position toward its second position;

a second latch surface on the lever engageable with the second notch to prevent rotation of the second cam out of its first position toward its second position;

means on the first cam for (a) moving the second latch surface into the rotative path of the second notch and preventing engagement of the first latch surface and the first notch when the second cam is in its first position and rotation of the first cam from its first to its second position is initiated, and (b) permitting the first latch surface to engage the first notch when the second cam is in its second position and rotation of the first cam from its first to its second position is initiated;

means on the second cam for (a) moving the first latch surface into the rotative path of the first notch and preventing engagement of the second latch surface and the second notch when the first cam is in its first position and rotation of the second cam from its first to its second position is initiated, and (b) permitting the second latch surface to engage the second notch when the first cam is in its second position and rotation of the second cam from its first to its second position is initiated;

a first cam follower surface on the lever engageable by the periphery of the first cam for holding the second latch surface in the rotative path of the second notch when the second cam is in the first position and the first cam rotates, or has rotated, from its first to its second position; and a second cam follower surface on the lever engageable by the periphery of the second cam for holding the first latch surface in the rotative path of the first notch when the first cam is in its first position and the second cam rotates, or has rotated, from its first to its second position.

11. In high-voltage switchgear of the type having two three-phase, high-voltage switches connectable to respective sources at different potentials and rotatable between open and closed positions, improved apparatus for preventing the simultaneous closure of the switches to thereby prevent the sources from being connected in electrical parallel with respect to a bus common to the switches; wherein the improved apparatus comprises:

first means rotatable in response to rotation of one of the switches and having a first position when the one switch is open and a second position when the one switch is closed;

a first notch in the first means;

a first cam surface on the first means;

second means rotatable in response to rotation of the other switch and having a first position when the other switch is open and a second position when the other switch is closed;

a second notch in the second means;

a second cam surface on the second means;

means for mounting the first and second rotatable means in a common plane on separated axes of rotation and for preventing rotation of the switches if their associated rotating means cannot rotate; and a member mounted for movement in the plane of rotation of the first and second rotatable means, the member having a first latch surface engageable with the first notch to prevent rotation of the first rotatable means and a second latch surface engageable with the second notch to prevent rotation of the second rotatable means, rotation of the first means from its first to its second position while the second means is in its first position moving the first cam surface against the member to move the member so that the second latch surface is in the path of rotation of and engages the second notch should the second means thereafter attempt to rotate, rotation of the second means from its first to its second position while the first means is in its first position moving the second cam surface against the member to move the member so that the first latch is in the path of rotation of and engages the first notch should the first means thereafter attempt to rotate.

* * * * *